US006490363B1

(12) United States Patent
Liu

(10) Patent No.: US 6,490,363 B1
(45) Date of Patent: Dec. 3, 2002

(54) STRUCTURE OF SPEAKER

(76) Inventor: Chun-I Liu, No. 20-2, Lane 254, Nan-Ping Rd., Taoyuan City (TW)

( * ) Notice: Subject to any disclaimer, the term of this patent is extended or adjusted under 35 U.S.C. 154(b) by 0 days.

(21) Appl. No.: 09/417,046

(22) Filed: Oct. 13, 1999

(51) Int. Cl.[7] ..... H04R 25/01
(52) U.S. Cl. ..... 381/403; 381/430; 381/420; 381/404; 381/398
(58) Field of Search ..... 381/398, 420, 381/386, 396, 400, 403–405, 412, 419, 423, FOR 151, FOR 152, FOR 153, FOR 157, FOR 159, FOR 161, FOR 162, FOR 163, FOR 165, 427, 428, 430, 431; 181/171, 172

(56) References Cited

U.S. PATENT DOCUMENTS 2,234,007 A * 3/1941 Olson et al. ..... 181/172
2,814,353 A * 11/1957 Olson et al. ..... 181/172
6,173,065 B1 * 1/2001 Lin ..... 381/398

* cited by examiner

*Primary Examiner*—Sinh Tran
*Assistant Examiner*—P. Dabney
(74) *Attorney, Agent, or Firm*—Troxell Law Office PLLC

(57) ABSTRACT

An improved speaker structure includes dual suspension edges connecting a support seat, a sound ring and a diaphragm. Therefore, when the speaker outputs, the dual suspension edge will not deviate and can perform a highly vertical cutting movement. Besides, the dual suspension edge can perform a flip-flop movement and distribution, and can compensate insufficient tensile force during reverse vibration so as to increase power, reduce distortion, and enable the diaphragm to be independently secured to a top portion of the sound ring to obtain better sound quality.

1 Claim, 3 Drawing Sheets

STRUCTURE OF SPEAKER

BACKGROUND OF THE INVENTION (a) Field of the Invention

The present invention relates to an improved speaker structure having upper and lower oppositely disposed dual suspension edges adapted particularly for use in speakers, speaker cabinets or multimedia that output sound.

(b) Description of the Prior Art

FIG. 1 shows a conventional speaker structure. Suspension edges thereof are located at a joint between a diaphragm of the speaker and the frame body for supporting the periphery of the diaphragm and breaking air movement in front of or behind the diaphragm to facilitate forward and backward movement of the sound ring.

Preferred suspension edges should have the following points: (1) Good support; (2) suitable flexibility; and (3) preferred shock-absorbing power and restorability. Good support can allow the sound ring to maintain a linear reciprocating movement. Suitable flexibility will not cause undue hardness or rigidity of the suspension edges, which will hamper the reciprocating movement of the sound ring or result in deformation. Shock-absorbing power and restorability will particularly affect the fidelity of the middle and low sound ranges. The structure, as mentioned above, has only a single ring adhered to the diagram. There are the following drawbacks in terms of practical use:

1. For the sound rings, the indirect support through the diaphragm cannot enable the sound rings to perform the best and most stable vertical cutting movement. If power is high, vibration and hence sound distortion may occur, which may in turn limit the output.
2. The method of connecting the sound ring through the diaphragm makes it difficult to further reduce the size of the speaker body under the condition of high quality requirement.

In view of the above-mentioned drawbacks with the suspension edges of conventional speakers, the present invention aims to provide an improved speaker structure that include upper and lower suspension edges that have curves disposed opposite to each other so that they can perform a flip-flop movement during vertical displacement thereof to compensate the insufficient tensile force upon reverse vibration during the vertical displacement.

SUMMARY OF THE INVENTION

A primary object of the present invention is to provide an improved speaker structure that can compensate the insufficient tensile force upon reverse vibration during vertical movement to achieve stable vertical movement.

Another object of the present invention is to provide an improved speaker structure that can enhance power and sound quality.

In order to achieve the above-mentioned objects, the present invention includes upper and lower oppositely disposed curved suspension edges connectedly disposed between an O ring and a sound ring. When the speaker performs vertical movement during output, the oppositely disposed dual suspension edge structure can perform a flip-flop movement to compensate for the insufficient tensile force upon reverse vibration during the vertical movement and stable vertical movement so as to enhance power and enable the diaphragm to be secured independently on a top portion of the sound ring, thereby achieving better sound quality and avoiding distortion.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
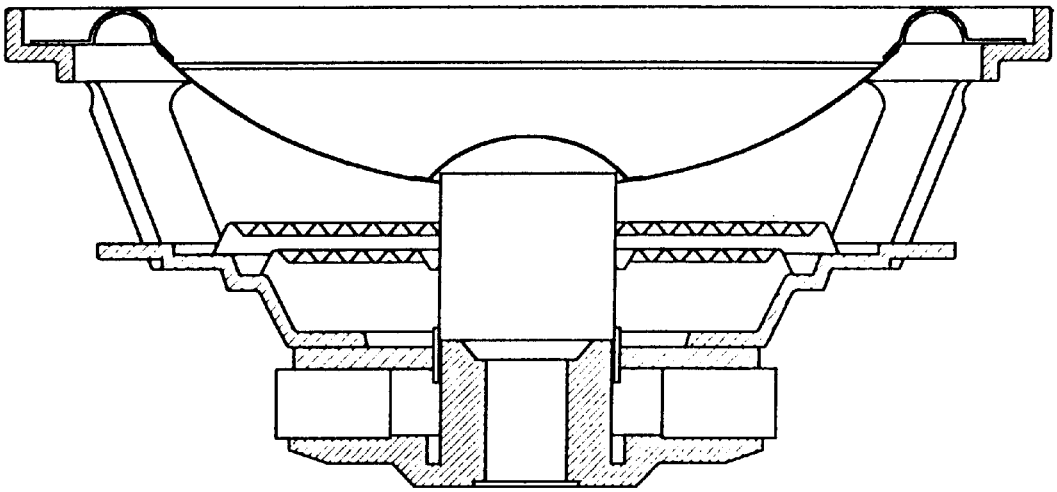
FIG.1 (Prior Art)
FIG. 1 is a sectional view of a conventional speaker.
Figure 2:
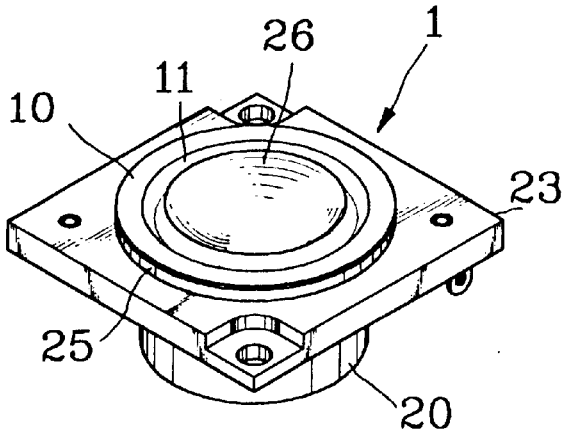
FIG. 2 is a perspective view of the present invention.
Figure 3:
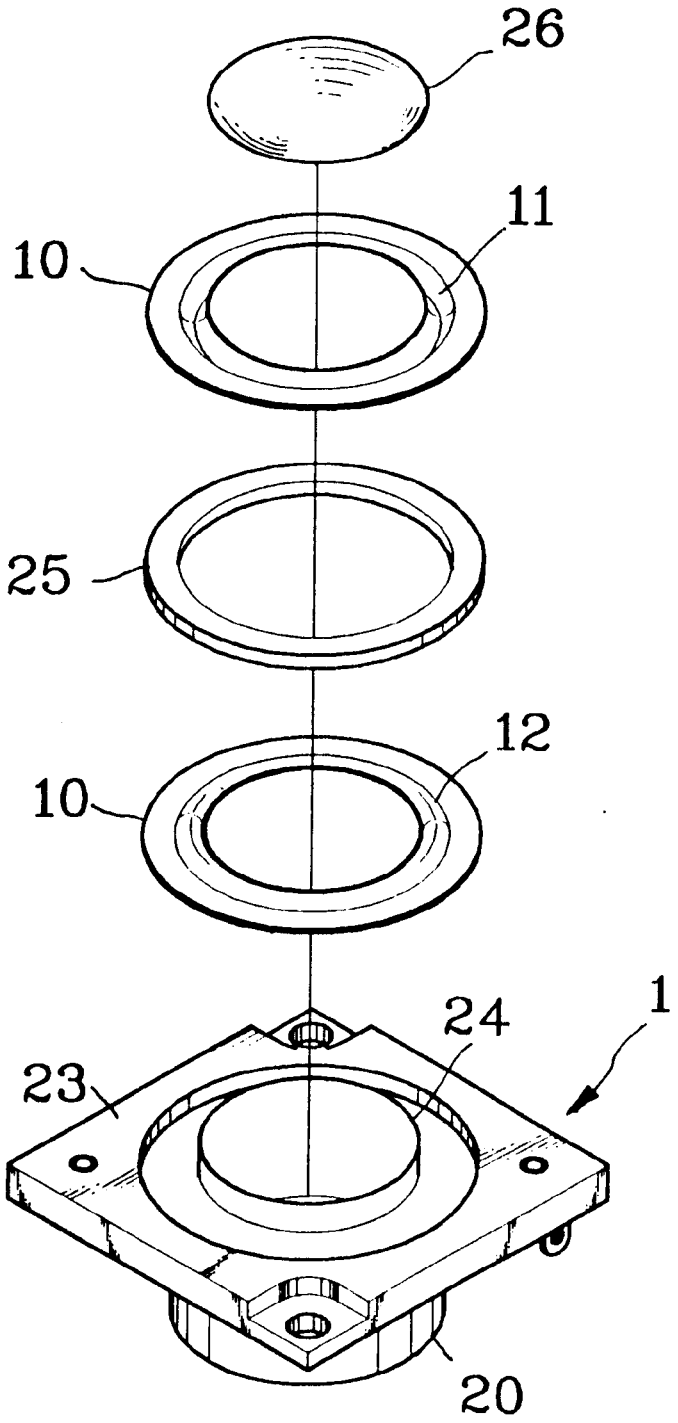
FIG. 3 is an exploded perspective view of the present invention.
Figure 4:
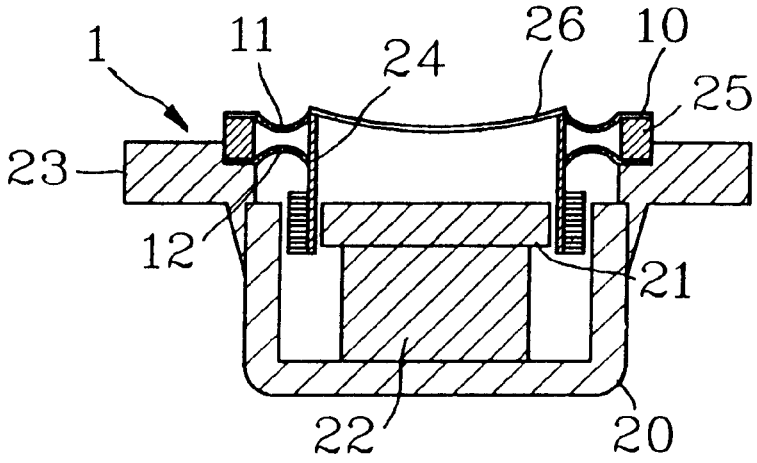
FIG. 4 is an assembled plan view of the present invention.

Referring to FIGS. 2, 3 and 4, a speaker 1 of the present invention basically includes an annular iron 20, a support seat 23, a magnet 22, a washer 21, a sound ring 24, a diaphragm 26, an O ring 25, and a suspension edge 10. A top portion of the annular iron 20 is connected to the support seat 23. The annular iron 20 has an annular interior accommodating the magnet 22 and washer 21. A periphery of the washer 21 is provided with the sound ring 24. The sound ring 24 is located higher than the support seat 23, and has a top end covered by the diaphragm 26. An inner edge of the support seat 23 is provided with the washer 25. The suspension edge 10 is connectedly disposed in a clearance between the sound ring 24 and the O ring 25.

Figure 5:
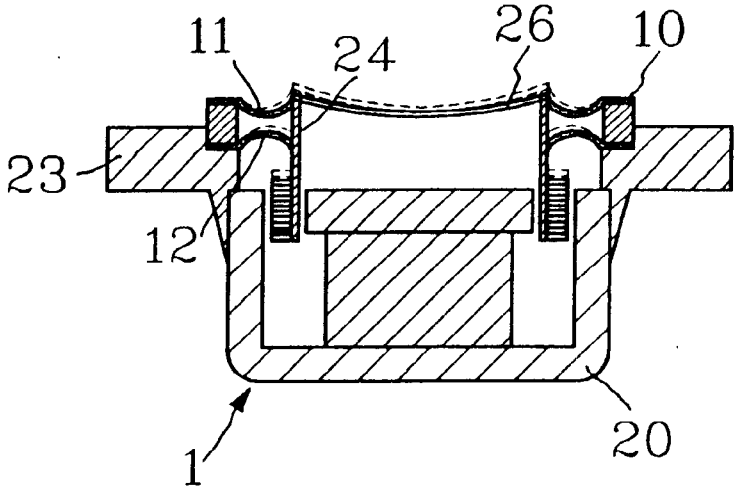
FIG. 5 is a schematic view illustrating operation of the present invention.

As best shown in FIG. 4, the improvement provided by the present invention resides in that the suspension edge 10 has a concavo-concave cross section including an upper edge being an upper concave face 11 that sinks downwardly and a bottom edge being a projecting face 12 that projects upwardly, thereby forming dual suspension edges of upper and lower curves disposed opposite to each other so that the suspension edge 10 may, during forward and backward movement as shown in FIG. 5, utilizes its own good elasticity and the opposite curves to generate an upward and downward flip-flop balancing effect, distributing the eccentricity of the piston and thereby causing it to perform more vertical reciprocating movement without deviation. At the same time, this can compensate the insufficient tensile force generated during reverse vibration to obtain perfect sound quality.

In addition, in terms of the overall construction, since the suspension edge 10 is directly adhered and secured on the sound ring 24 not via the diaphragm 26, the overall size can be effectively and considerably reduced. More importantly, the configuration of the dual suspension edges strengthens the stability of the vibration of the sound ring 24 so that the output power can relatively be enhanced to a considerable extent, surpassing conventional products.

In summary, the present invention having a dual suspension edge structure having opposite curves, as compared to the prior art, can stabilize the movement of the piston so that the output of the speaker is enhanced. The structure of the invention can also help upgrade the manufacturing technique of high-power, high-fidelity compact speakers.

Although the present invention has been illustrated and described with reference to the preferred embodiment thereof, it should be understood that it is in no way limited to the details of such embodiment but is capable of numerous modifications within the scope of the appended claims.

What is claimed is:

1. A speaker structure comprising:

a) an annular iron having a bottom and an edge portion, the annular iron having a U-shaped cross-sectional configuration;

b) a support seat mounted on the edge portion of the annular iron and extending outwardly therefrom;

c) a magnet mounted on the bottom of the annular iron and having a washer thereon spaced from the annular iron so as to form a gap therebetween;

d) an annular sound ring having open first and second ends, the first end located in the gap between the washer and the annular iron;

e) a concavely curved diaphragm attached to and extending across the second end of the annular sound ring so as to close the second end;

f) an O-ring located on the support seat adjacent to the second end of the annular sound ring; and, g) a dual suspension edge connecting the second end of the annular sound ring to the O-ring, the dual suspension edge having two oppositely facing, spaced apart, concavely curved surfaces, each concavely curved surface connected to the O-ring and to the annular sound ring.

* * * * *